US011760115B2

(12) United States Patent
Iijima et al.

(10) Patent No.: US 11,760,115 B2
(45) Date of Patent: Sep. 19, 2023

(54) TAPE CASSETTE HAVING CONVEYING PASSAGE FOR CONVEYING TAPE

(71) Applicant: BROTHER KOGYO KABUSHIKI KAISHA, Nagoya (JP)

(72) Inventors: Shota Iijima, Nagoya (JP); Yuki Hokari, Nagoya (JP); Satoru Ito, Nagoya (JP); Masaya Fujita, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/941,807

(22) Filed: Jul. 29, 2020

(65) Prior Publication Data

US 2021/0031546 A1 Feb. 4, 2021

(30) Foreign Application Priority Data

Jul. 31, 2019 (JP) ..... 2019-141362

(51) Int. Cl.
*B41J 15/04* (2006.01)
*B41J 2/32* (2006.01)

(52) U.S. Cl.
CPC ..... *B41J 15/044* (2013.01); *B41J 2/32* (2013.01)

(58) Field of Classification Search
None
See application file for complete search history.

(56) References Cited

U.S. PATENT DOCUMENTS 3,823,808 A * 7/1974 Minoru ..... G06C 11/12 400/615.2
4,502,801 A * 3/1985 Hefti ..... B41J 33/26 400/208
5,188,469 A * 2/1993 Nagao ..... B41J 3/4075 156/387
5,296,084 A 3/1994 Hattori et al.
(Continued)

FOREIGN PATENT DOCUMENTS

CN 1135417 A 11/1996
EP 0322919 A2 * 7/1989 ..... B41J 11/703
(Continued)

OTHER PUBLICATIONS

Translation of Kodama (Year: 2017).*
(Continued)

*Primary Examiner* — Matthew G Marini
(74) *Attorney, Agent, or Firm* — Kenealy Vaidya LLP

(57) ABSTRACT

A tape cassette used for a printer includes a thermal head and a cassette holder to which the tape cassette is attachable. The tape cassette includes a tape roll, a casing, a regulation guide and a pressure member. The tape roll is formed by winding a tape. The tape has a width defining a widthwise direction. The casing accommodates therein the tape roll. A tape conveying passage is defined in the casing. The regulation guide is positioned at the tape conveying passage to restrict displacement of the tape in the widthwise direction. The pressure member is positioned upstream of the regulation guide in a conveying direction of the tape and along the tape conveying passage. The pressure member is in contact with the tape in a contacting direction to apply pressing force to the tape in the contacting direction.

15 Claims, 13 Drawing Sheets

(56) References Cited

U.S. PATENT DOCUMENTS

| | | | | |
|---|---|---|---|---|
| 5,685,654 | A | 11/1997 | Nagao et al. | |
| 6,135,657 | A * | 10/2000 | Martinez | B41J 33/52 400/208 |
| 6,520,696 | B2 * | 2/2003 | Huss | B41J 15/04 400/208 |
| 2010/0247207 | A1 | 9/2010 | Sago et al. | |
| 2010/0247208 | A1 | 9/2010 | Yamaguchi et al. | |
| 2010/0247212 | A1 | 9/2010 | Yamaguchi et al. | |
| 2012/0080550 | A1 | 4/2012 | Yamaguchi et al. | |
| 2018/0015758 | A1 * | 1/2018 | Murata | B41J 2/325 |
| 2019/0023038 | A1 | 1/2019 | Kodama et al. | |

FOREIGN PATENT DOCUMENTS

| | | | | |
|---|---|---|---|---|
| EP | 3 434 493 | A1 | 1/2019 | |
| EP | 3434493 | A1 * | 1/2019 | B41J 11/70 |
| JP | S56-056453 | A | 5/1981 | |
| JP | H02-057863 | U | 4/1990 | |
| JP | H02-106555 | A | 4/1990 | |
| JP | 2000-108471 | A | 4/2000 | |
| JP | 2010-234775 | A | 10/2010 | |
| JP | 2017-170834 | A | 9/2017 | |
| WO | WO-03080350 | A1 * | 10/2003 | B41J 15/044 |
| WO | WO-2017164314 | A1 * | 9/2017 | B41J 11/70 |

OTHER PUBLICATIONS

Extended European Search Report for the related European Patent Application No. 20188278.4 dated Dec. 10, 2020.
Japanese Office Action for the related Japanese Patent Application No. 2019-141362 dated May 26, 2023.

* cited by examiner

TAPE CASSETTE HAVING CONVEYING PASSAGE FOR CONVEYING TAPE

CROSS REFERENCE TO RELATED APPLICATION

This application claims priority from Japanese Patent Application No. 2019-141362 filed Jul. 31, 2019. The entire content of the priority application is incorporated herein by reference.

TECHNICAL FIELD

The present disclosure relates to a tape cassette to be attached to a cassette holder of a printer.

BACKGROUND

There has been known a printing technology where a tape cassette is attached to a cassette holder of a printer, and printing is performed on a tape supplied from the tape cassette as described in United States Patent Application Publication No. 2019/0023038 A1. According to the US Publication, a regulation guide (a tape lead-out portion) is positioned adjacent to a tape exit of the tape cassette to restrict displacement of the tape in a widthwise direction of the tape (fabric tape) when the tape paid out from a tape roll is conveyed along a conveying passage.

SUMMARY

However, the regulation guide may not exhibit sufficient function of restricting the displacement of the tape in its widthwise direction due to an employment of a tape having low rigidity or linearity. Therefore, diagonal running of the tape, folding of the tape and wrinkle of the tape may occur.

In view of the foregoing, it is an object of the disclosure to provide a tape cassette capable of avoiding occurrence of diagonal running of the tape, folding of the tape and wrinkle of the tape even by an employment of the tape having low rigidity.

In order to attain the above and other objects, according to one aspect, the disclosure provides a tape cassette used for a printer including a thermal head and a cassette holder to which the tape cassette is attachable. The tape cassette includes a tape roll, a casing, a regulation guide and a pressure member. The tape roll is formed by winding a tape. The tape has a width defining a widthwise direction. The casing accommodates therein the tape roll. A tape conveying passage is defined in the casing. The regulation guide is positioned at the tape conveying passage to restrict displacement of the tape in the widthwise direction. The pressure member is positioned upstream of the regulation guide in a conveying direction of the tape and along the tape conveying passage. The pressure member is in contact with the tape in a contacting direction to apply pressing force to the tape in the contacting direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
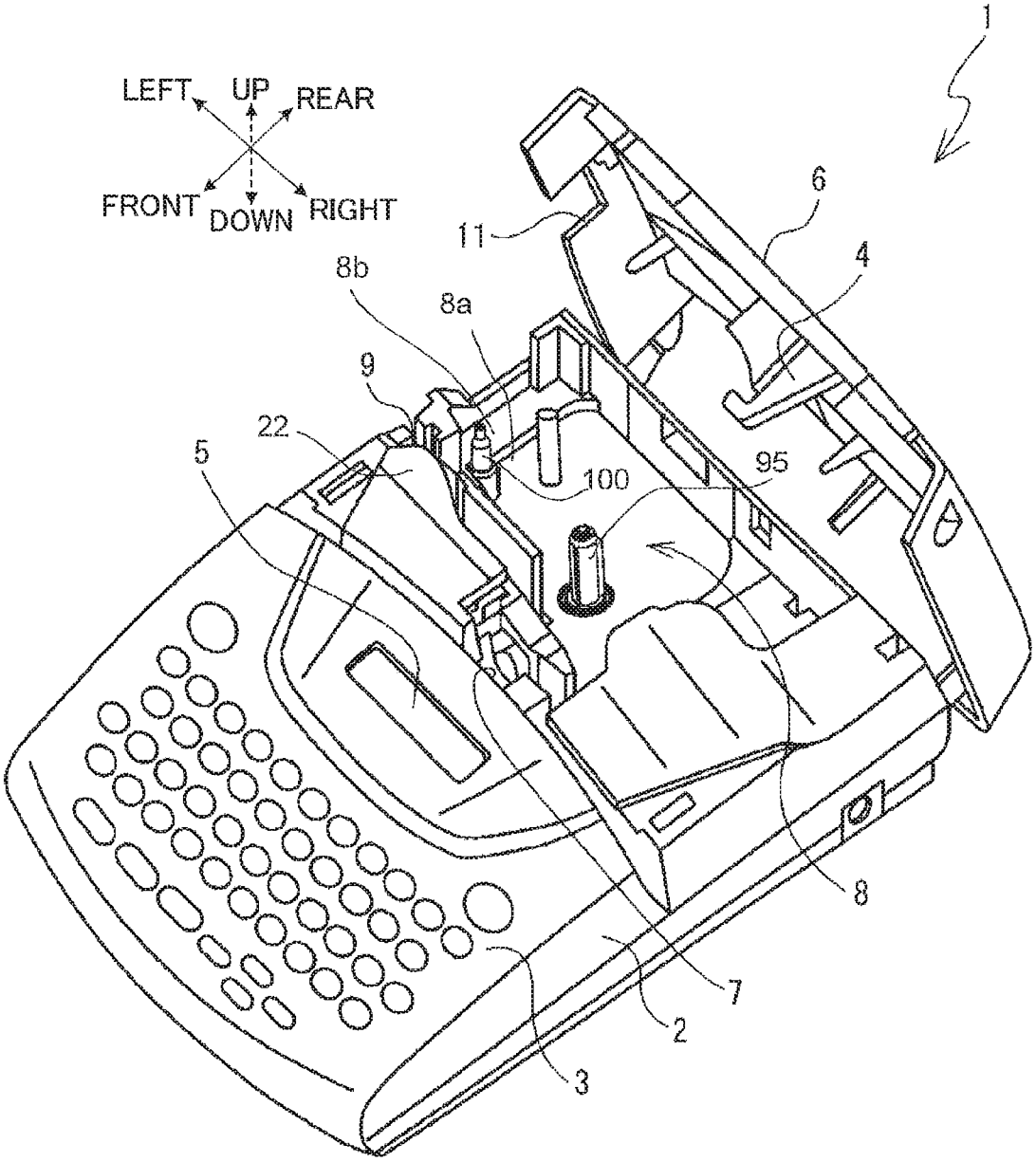
FIG. 1 is a perspective view of a tape printer to which a tape cartridge according to a first embodiment is attached, and particularly illustrating an open state of a cover.

Hereinafter, a tape cartridge according to the present disclosure will be described with reference to accompanying drawings. The terms "front", "rear", "right", "left", "above", "below", and the like will be used throughout the description on a basis of FIG. 1. That is, a diagonal lower left side in FIG. 1 will be referred to as "front side", a diagonal upper right side in FIG. 1 will be referred to as "rear side", a diagonal lower right side in FIG. 1 will be referred to as "right side", and a diagonal upper left side in FIG. 1 will be referred to as "left side" (see also arrows illustrated in each drawing). Further, each component illustrated in the drawings is not to scale for better understanding to the structure.

First, a tape cartridge according to a first embodiment will be described with reference to FIGS. 1 through 11.

[Outline of Tape Printer]

A general structure of a tape printer 1 to which the tape cartridge is attachable will be described. As illustrated in FIG. 1, the tape printer 1 includes a main body cover 2 where a key board 3 and a liquid crystal display 5 are provided. The liquid crystal display 5 is positioned rearward of the key board 3. A cover 6 configured to be opened and closed is positioned rearward of the liquid crystal display 5. A cartridge receiving portion 8 having a recessed configuration is positioned at an internal space of the main body cover 2. The cartridge receiving portion 8 is configured to receive a tape cartridge 30 described later. The tape cartridge 30 is an example of a "tape cassette", and the cartridge receiving portion 8 is an example of a "cassette holder".

The main body cover 2 has a left rear portion where an ejection slit 9 is formed for ejecting printed fabric tape 153 described later outside of the main body cover 2. Further, the main body cover 2 is formed with a locking hole 7. The cover 6 includes a left side wall where an ejection window 11 is formed. The cover 6 has a front center portion where a locking protrusion 4 is provided. Upon closure of the cover 6, the locking protrusion 4 is engaged with the locking hole 7.

[Cartridge Receiving Portion]

Figure 2:
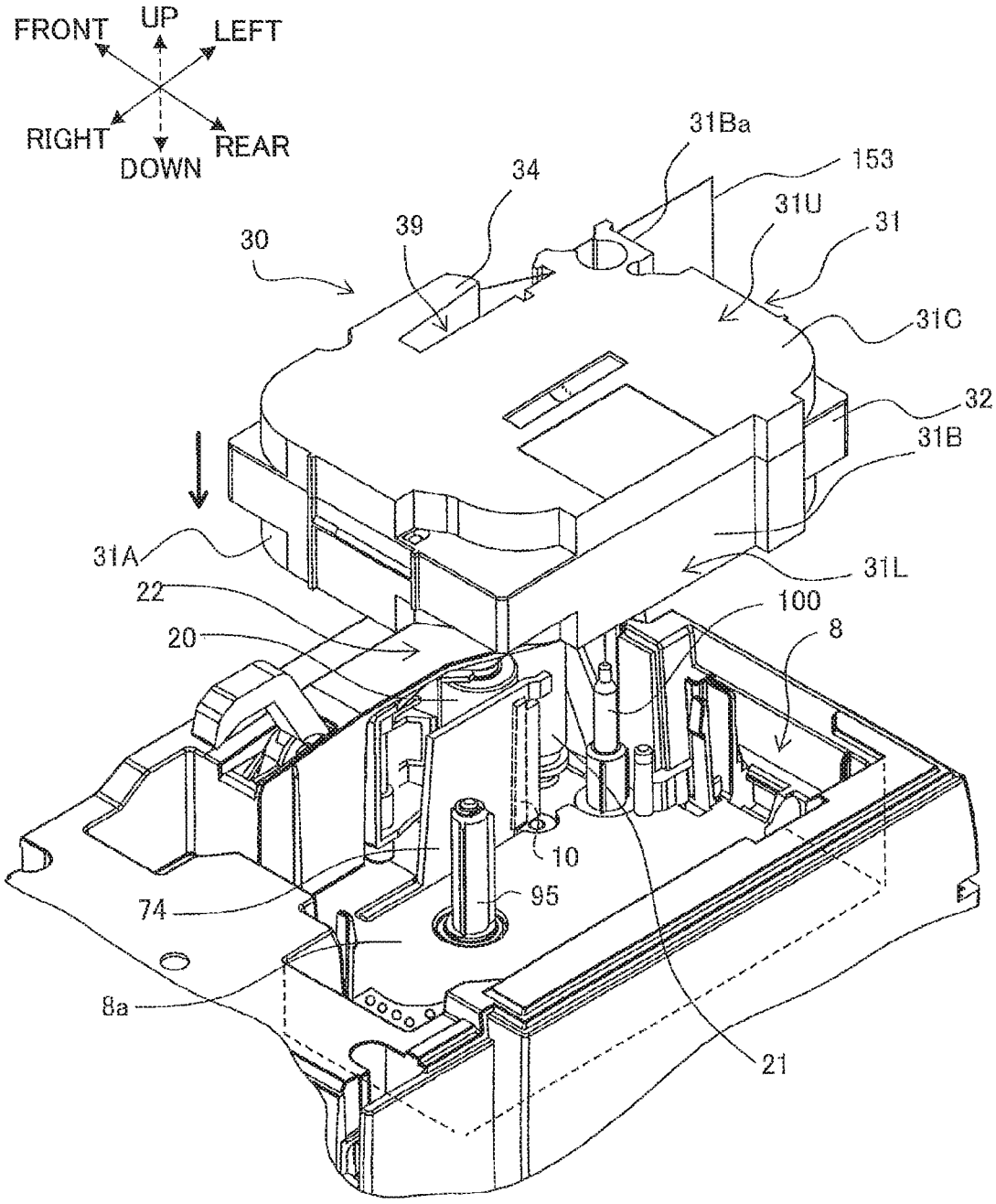
FIG. 2 is a perspective view of the tape cartridge according to the first embodiment and a cartridge receiving portion of the tape printer to which the tape cartridge is attachable.

As illustrated in FIG. 2, a head holder 74, a ribbon take-up shaft 95, and a tape drive shaft 100 are provided in the cartridge receiving portion 8. A thermal head 10 including heat generating elements (not illustrated) is mounted on the head holder 74. A tape feed motor (not illustrated) including a drive shaft is positioned outside the cartridge receiving portion 8. The drive shaft is drivingly connected to the ribbon take-up shaft 95 and the tape drive shaft 100 through a gear mechanism (not illustrated) including a plurality of gears.

Further, a roller holder 22 is provided in the cartridge receiving portion 8. The roller holder 22 is pivotally movable about an axis of a support shaft m (FIG. 6) by a change-over mechanism (not illustrated) between a printing position illustrated in FIGS. 2 and 6 and a release position. A platen roller 20 and a conveyer roller 21 are rotatably supported by the roller holder 22.

Incidentally, a tape cutter mechanism is provided at a cutting position adjacent to the ejection slit 9 for cutting the fabric tape 153 ejected out of the tape cartridge 30 at a predetermined position to provide a printed tape,

[Internal Structure of Tape Cartridge]

Next, an internal structure of the tape cartridge 30 in connection with the cartridge receiving portion 8 will be described with reference to FIGS. 2 through 4. The tape cartridge 30 includes a cartridge case 31 as an example of a "casing". The cartridge case 31 includes an upper wall portion 31U, and a lower wall portion 31L.

A combination of the upper wall portion 31U and the lower wall portion 31L provides a generally box-like configuration having an upper surface 31C, a bottom surface 31A, and a side surface 31B connecting the upper surface 31C to the bottom surface 31A in upward downward direction. The tape cartridge 30 is configured to be inserted into the cartridge receiving portion 8 such that the bottom surface 31A is a leading end for the insertion, and the cartridge receiving portion 8 supports the tape cartridge 30 from below.

The side surface 31B has a specific area 31Ba formed with a tape discharge opening 49*a* through which the fabric tape 153 on which an image is printed is configured to be discharged outside the cartridge case 31 such that a widthwise direction of the fabric tape 153 is directed in upward/downward direction. The specific area 31Ba is positioned at a most downstream end portion of a tape conveying passage along which the printed fabric tape 153 is conveyed inside the cartridge case 31.

The cartridge case 31 has a rear left portion where a support hole 65 is formed, and a tape spool 40 is rotatably supported by the support hole 65, The fabric tape 153 as an example of "tape" or "fabric tape" is wound over the tape spool 40. Incidentally, a combination of the tape spool 40 and the fabric tape 153 wound thereover constitutes a tape roll 206. The tape roll 206 has an axis K which is also an axis of the tape spool 40. The axis K extends in upward/downward direction.

A resin film 207 having a disc shape is positioned between an upper end of the tape roll 206 and a lower surface of the upper wall portion 31U. The resin film 207 is in contact with a widthwise edge (specifically an upper edge) of the fabric tape 153 of the tape roll 206.

Further, a ribbon spool 42 is positioned at a front right internal portion of the cartridge case 31, and an ink ribbon 60 is wound over the ribbon spool 42. A combination of the ribbon spool 42 and the ink ribbon 60 wound thereover constitutes a ribbon roll 306 as an example of a "ribbon supply roll."

The cartridge case 31 is formed with a support hole 67, and a ribbon take-up spool 44 is rotatably supported by the support hole 67. The ribbon take-up spool 44 is at a position between the tape spool 40 and the ribbon spool 42 inside the cartridge case 31. The ribbon take-up spool 44 is configured to pull out the ink ribbon 60 from the ribbon spool 42 and to take-up the ink ribbon 60 used for priming. Incidentally, a combination of the ribbon take-up spool 44 and the ink ribbon 60 used for printing and taken-up by the ribbon take-up spool 44 constitutes a ribbon take-up roll 307.

Upon attachment of the tape cartridge 30 to the cartridge receiving portion 8, the ribbon take-up shaft 95 is inserted in the ribbon take-up spool 44 to rotate the ribbon take-up spool 44.

Inside the cartridge case 31, guide portions b1, b2 are provided for regulating a conveying passage of the fabric tape 153 paid out from the tape roll 206, and a guide roller g is provided for regulating a conveying passage of the ink ribbon 60 paid out from the ribbon roll 306.

An arm portion 34 constitutes a front right portion of the tape cartridge 30. The arm portion 34 protrudes frontward from the cartridge case 31, and then is bent at right angle toward a center portion in leftward/rightward direction of the cartridge ease 31. The fabric tape 153 paid out from the tape roll 206 and moved past the guide portions b1, b2, and the ink ribbon 60 paid out from the ribbon roll 306 and moved past the guide roller g are configured to be guided into an internal space of the arm portion 34. In the internal space of the arm portion 34, a regulation guide 500A (described later) for guiding the fabric tape 153 is provided.

A space between the front surface of the cartridge case 31 and a rear surface of the arm portion 34 constitutes a head installing portion 39 where the head holder 74 on which the thermal head 10 is mounted can be positioned when the tape cartridge 30 is attached to the cartridge receiving portion 8. Further, a tape lead-out opening 34*a* is positioned at a tip end portion of the arm portion 34. The tape lead-out opening 34*a* is configured to direct the fabric tape 153 and the ink ribbon 60 positioned close to each other or overlapped with each other toward a head insertion recessed portion DB described later. The tape lead-out opening 34*a* is an example of a "lead-out portion".

Further, the cartridge case 31 is formed with a support hole at a position downstream of the head installing portion 39 in a conveying direction of the fabric tape 153 and the ink ribbon 60 from the tape lead-out opening 34*a* of the arm portion 34 to the tape discharge opening 49*a*. A tape drive roller 46 is rotatably supported by the support hole.

Upon attachment of the tape cartridge 30 to the cartridge receiving portion 8, the tape drive shaft 100 is inserted in the tape drive roller 46 to rotate the tape drive roller 46. Further, when the roller holder 22 is changed over to the printing position, the platen roller 20 and the conveyer roller 21 are in pressure contact with the thermal head 10 and the tape drive roller 46, respectively. More specifically, the tape drive roller 46 nips the fabric tape 153 conveyed in leftward/rightward direction in cooperation with the conveyer roller 21 in order to pay out convey the fabric tape 153 from the tape spool 40. Further, the above-described cutter mechanism is positioned at the tape conveying passage and between the tape discharge opening 49*a* and the ejection slit 9.

A pair of upper and lower guide members 36 is positioned upstream of the tape drive roller 46. The guide members 36 are configured to guide the fabric tape 153 toward the tape discharge opening 49*a* allowing the fabric tape 153 to pass through between the guide members 36.

A guide wall 38 extends in upward/downward direction at a position adjacent to the guide members 36. The guide wall 38 is configured to position the used ink ribbon 60 conveyed and moved past the head installing portion 39 away from the fabric tape 153 and to guide the fabric tape 153 toward the ribbon take-up spool 44. Further, a separation wall 48 extends in upward/downward direction at a position between the guide wall 38 and the ribbon take-up spool 44 so as to prevent the used ink ribbon 60 moved past the guide wall 38 to contact the fabric tape 153 wound over the tape spool 40.

Further, the tape cartridge 30 has a contact treatment recessed portion D positioned upstream of the tape discharge opening 49*a* in the conveying passage of the fabric tape 153. The contact treatment recessed portion D provides a treatment space for performing conveyance of the fabric tape 153 and printing on the fabric tape 153.

That is, the contact treatment recessed portion D includes an abutment purpose recessed portion DA and the head insertion recessed portion DB positioned upstream of the abutment purpose recessed portion DA. The conveyer roller 21 is movable toward the tape drive roller 46 to convey the fabric tape 153 in the abutment purpose recessed portion DA. The thermal head 10 is insertable in the head insertion recessed portion DB. The arm portion 34 extends toward the head insertion recessed portion. DB. The head insertion recessed portion DB is an example of a "recessed portion).

The tape cartridge 30 also includes a tape insertion portion 49. The tape insertion portion 49 has a downstream end in the conveying passage where the above-described tape discharge opening 49*a* is funned, and has an upstream end in the conveying direction where a tape introduction opening 49*b* opening to the abutment purpose recessed portion DA is formed, hence, the tape insertion portion 49 allows the fabric tape 153 to be inserted therein through the tape introduction opening 49*b*, and to be discharged outside of the tape cartridge 30 through the tape discharge opening 49*a*.

The above-described tape lead-out opening 34*a* formed in the arm portion 34 is open to the head insertion recessed portion DB. Hence, the fabric tape 153 paid out from the tape roll 206 and the ink ribbon 60 paid out from the ribbon roll 306 are directed toward the head insertion recessed portion DB through the tape lead-out opening 34*a* and are exposed to the outside of the cartridge case 31.

Figure 3:
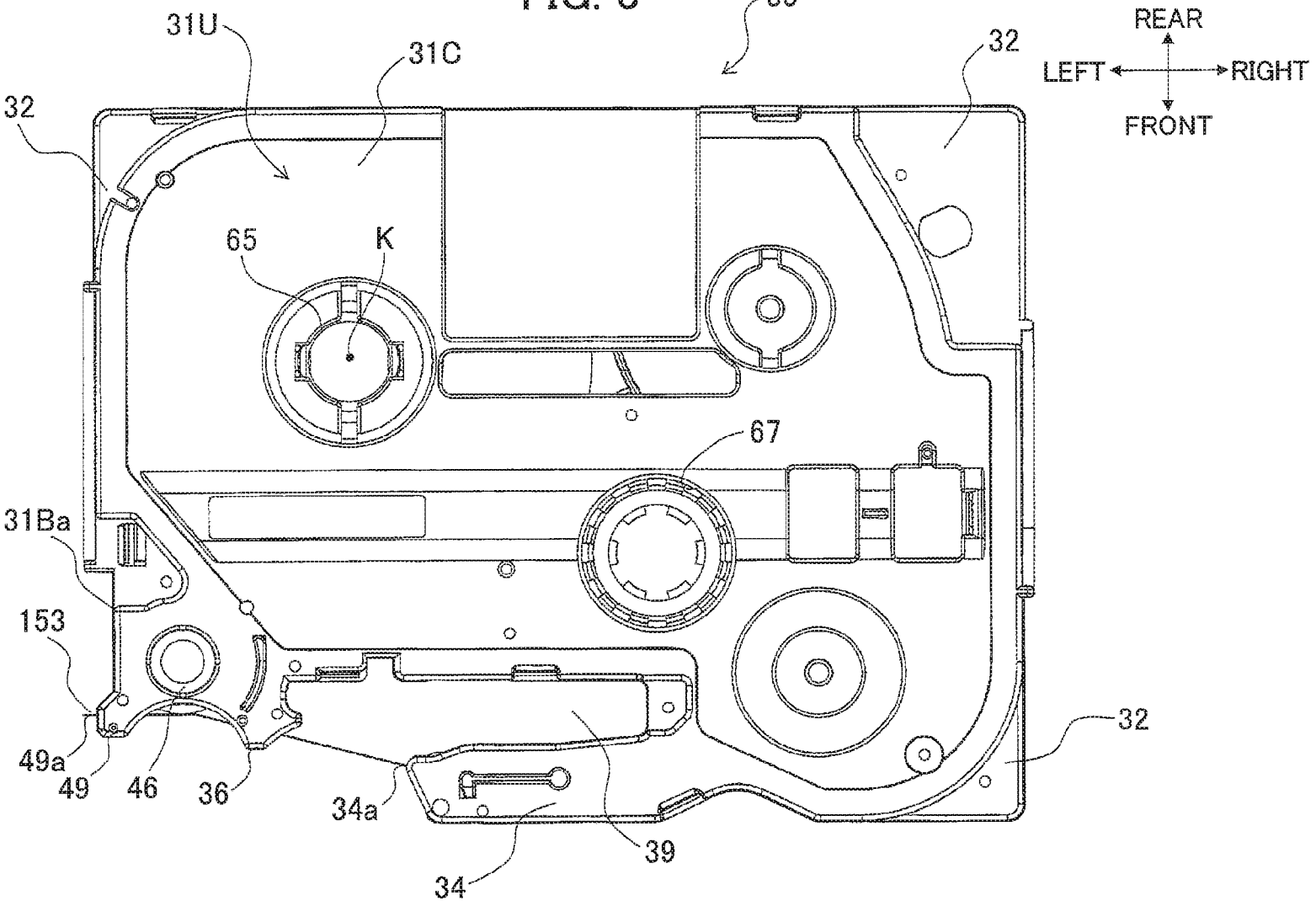
FIG. 3 is a plan view of the tape cartridge according to the first embodiment.
Figure 4:
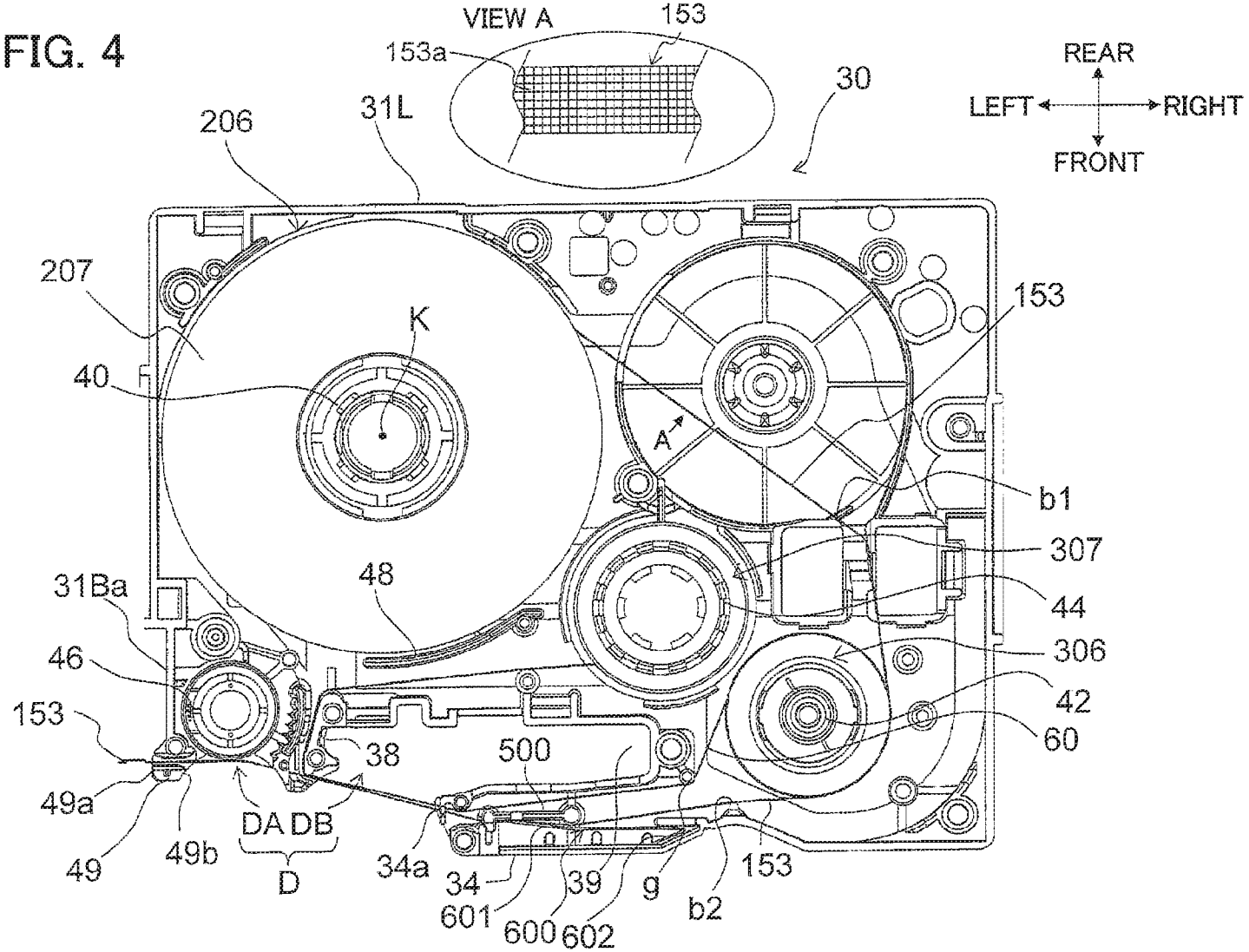
FIG. 4 is a plan view illustrating an internal structure of the tape cartridge with omitting an upper wall of a casing of the cartridge.

Further, as illustrated in FIGS. 2 and 3, the cartridge case 31 has three corner portions 32 except a corner portion where the tape discharge opening 49*a* is formed. Each of the corner portions 32 functions as a compatible portion 32 having a right-angled corner in plan view and positioned at an intermediate portion in upward/downward direction of the cartridge case 31.

On the other hand, as illustrated in FIGS. 1 and 2, the cartridge receiving portion 8 has a recessed portion 8*a* recessed downward in plan view. The recessed portion 8*a* has rounded corners. Further, the cartridge receiving portion 8 also has flat surface portions 8*b* positioned beside each upper end of each rounded corner. Each flat surface portion 8*b* functions as a cartridge support portion 8*b* configured to support each compatible portion 32 of the tape cartridge 30 from below.

When the tape cartridge 30 is inserted into the cartridge receiving portion 8, the compatible portions 32 are supported by the cartridge support portions 8*b* from below. The compatible portions 32 and the cartridge support portions 8*b* have dimensional relationship with each other so that a widthwise center of the fabric tape 153 supplied from the tape cartridge 30 is generally coincident with a center portion of an array of the heat generating elements in upward/downward direction of the thermal head 10 upon attachment of the tape cartridge 30 to the cartridge receiving portion 8.

Incidentally, various kinds of tape cartridges 30 are prepared. For example, a first kind of the tape cartridge 30 accommodates therein a first kind of fabric tape 153 having a first widthwise length, and a second kind of the tape cartridge 30 accommodates therein a second kind of fabric tape 153 having a second widthwise length different from the first widthwise length. The cartridge receiving portion 8 can receive various kinds of the tape cartridges 30 by previously determining dimension of the compatible portions 32 and the like so that the widthwise center of the fabric tape 153 of the attached tape cartridge 30 is generally coincident with the center portion of then array of the heat generating elements.

[Structure of Fabric Tape]

Figure 5A:
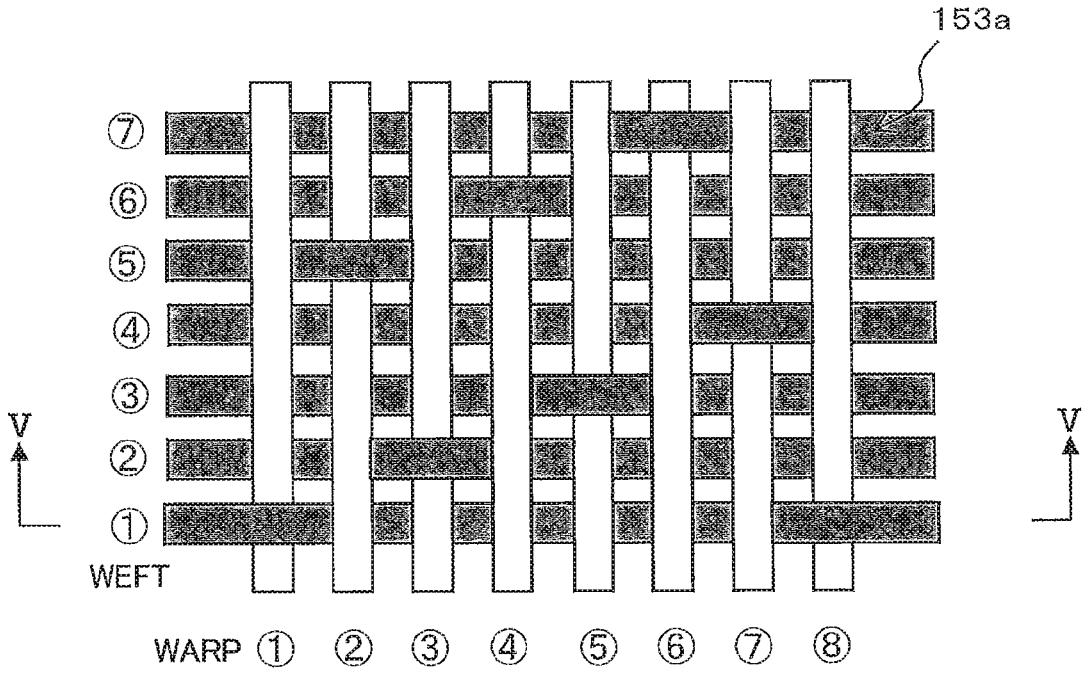
FIG. 5A is an enlarged schematic view illustrating a surface of a fabric tape on which printing is to be performed.
Figure 5B:
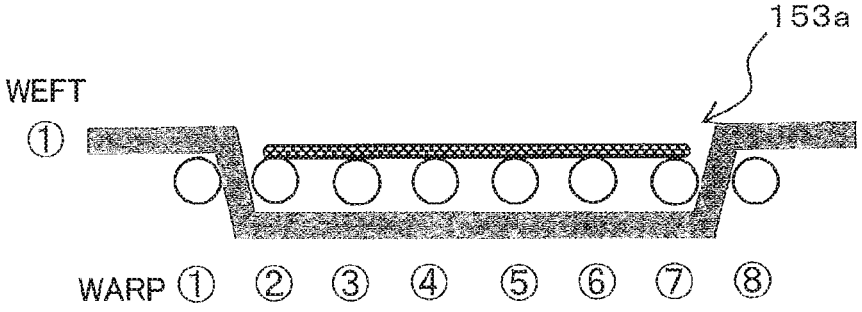
FIG. 5B is an enlarged cross-sectional view taken along the line V-V in FIG. 5A.

A structure of the fabric tape 153 will next be described. The fabric tape 153 is produced by weaving warp extending in a longitudinal direction of the tape and weft extending in a widthwise direction of the tape. According to the present embodiment, the fabric tape 153 is produced by satin weave where the warp area appearing on a surface of the fabric tape 153 is greater than weft area as illustrated in FIG. 5A. That is, the warp area exposed to the outside is greater than the weft area exposed to the outside at one of the surfaces of the fabric tape 153 in a thickness direction thereof as illustrated in FIG. 5*b*. The one of the surfaces illustrated in FIGS. 4 and 5A of the fabric tape 153 is an image receiving surface 153*a* on which image is printed.

As illustrated in FIGS. 5A and 5B, the fabric tape 153 is so called seven-harness satin. A region of the image receiving surface 153*a* illustrated in FIG. 5A is a weaving structure including eight warps ① through ⑧, and seven wefts ① through ⑦ intersecting with each other. Further, a conventional calendering treatment is applied to the image receiving surface 153*a* to enhance print quality. In the tape roll 206 according to the present embodiment, such a fabric tape 153 is wound over the tape spool 40 such that the image receiving surface 153*a* becomes an inner peripheral surface of the rolled tape.

[Operation in Tape Printer]

Figure 6:
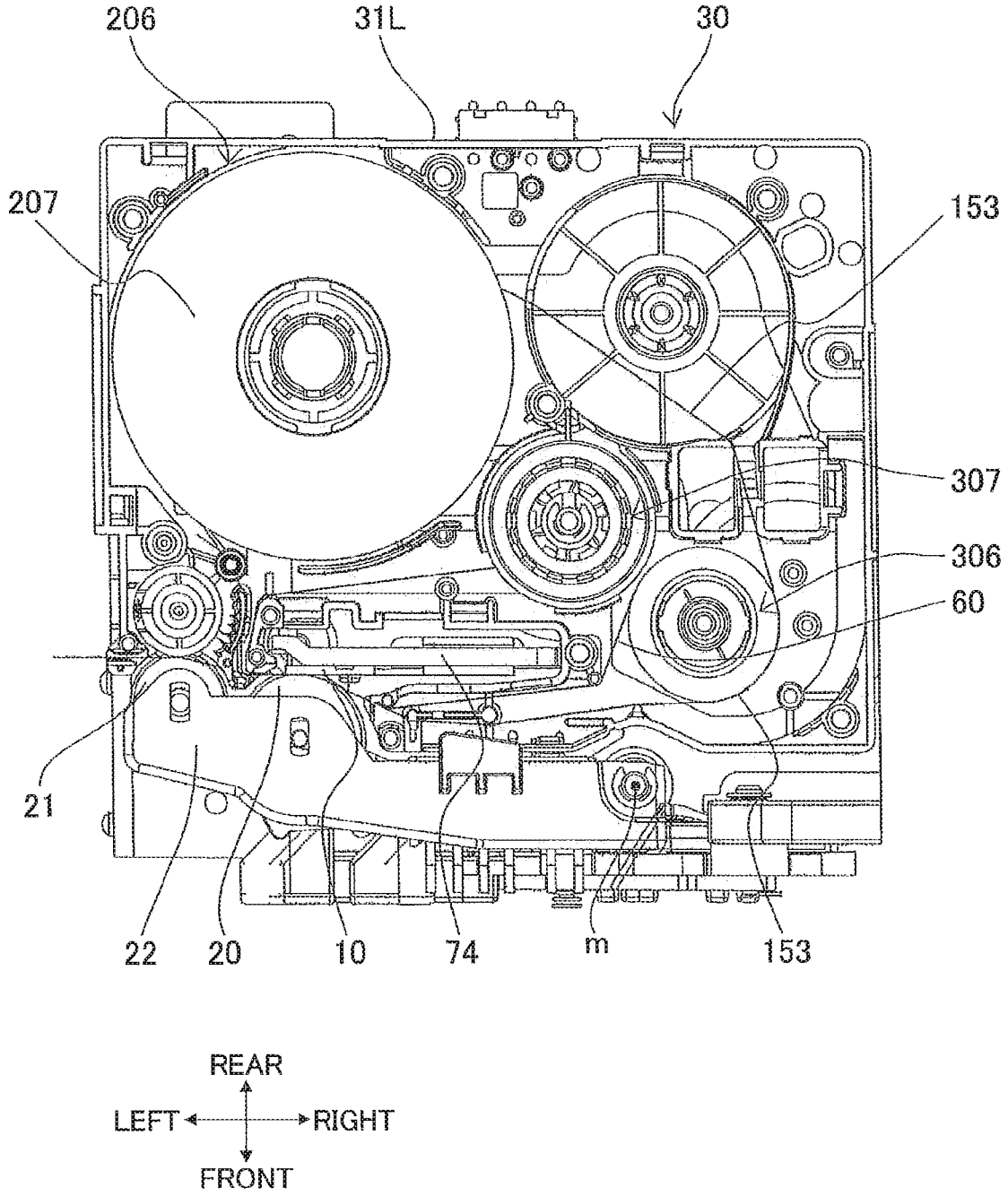
FIG. 6 is a plan view illustrating the view of FIG. 4 and a structure adjacent to the cartridge receiving portion for description of operation of the tape printer.

Operation performed in the tape printer 1 will be described with reference to FIGS. 6 and 7. The platen roller 20 and the conveyer roller 21 are pressed by the thermal head 10 and the tape drive roller 46, respectively as illustrated in FIG. 6 by changing-over the roller holder 22 to the printing position after the tape cartridge 30 is attached to the cartridge receiving portion 8. Accordingly, the conveying passage of the fabric tape 153 has a bent or angled shape by the platen roller 20 facing the thermal head 10 and by the regulation guide 500A positioned in the arm portion 34.

The ribbon take-up shaft 95 and the tape drive shaft 100 are rotated in synchronism with each other by the driving force of the tape feed motor. The rotation of the tape drive shaft 100 causes rotation of the tape drive roller 46, the platen roller 20, and the conveyer roller 21, so that the fabric tape 153 is paid out from the tape roll 206, and is conveyed as in a manner described above.

At this time, the plurality of heat generating elements mounted on the thermal head 10 generate heat, and the ink ribbon 60 is brought into contact with the image receiving surface 153*a* of the fabric tape 153 by being pressed against the thermal head 10. As a result, an ink in the ink ribbon 60 is thermally transferred onto the image receiving surface 153*a* to form a visible ink image on the image receiving surface 153*a*. The fabric tape 153 in which the image is formed is conveyed to the cutting position and is cut by the cutter mechanism. Then the fabric tape 153 is conveyed outside the tape cartridge 30 through the tape discharge opening 49*a*.

[Regulation Guide and Technical Task in Connection with the Guide]

As illustrated in FIGS. 4, 8A, 8B, 9A and 9B, a separation wall 500 as an example of a first wall is provided inside the arm portion 34 at a position between the conveying passages of the fabric tape 153 and the ink ribbon 60 for separating the fabric tape 153 and the ink ribbon 60 from each other. The above-described regulation guide 500A is positioned along the conveying passages and at a downstream end portion of the separation wall 500. The separation wall 500 has a front surface 500C.

The regulation guide 500A is positioned at the tape lead-out opening 34*a* positioned at the tip end of the arm portion 34. The regulation guide 500A extends in the widthwise direction (upward/downward direction) of the tape. The regulation guide 500A includes a base portion 500*a*, an upper guide portion 500*h* and a lower guide portion 500*c*.

The base portion 500*a* extends in upward/downward direction and protrudes frontward from the front surface 500C of the separation wall 500. The upper guide portion 500*b* extends frontward from one end portion (upper end portion) in the widthwise direction of the base portion 500*a*. The lower guide portion 500*c* extends frontward from another end portion (lower end portion) the widthwise direction of the base portion 500*a*. Thus, the regulation guide SODA has a generally U-shape. The base portion 500*a* is an example of one of the two protrusions.

With this structure, the regulation guide 500A restricts displacement in the widthwise direction (upward/downward direction) of the tape 153 that is conveyed along the conveying passage in the arm portion 34, while the fabric tape 153 passes through a space defined by the base portion 500*a*, the upper guide portion 500*b*, and the lower guide portion 500*c*.

However, in the tape cartridge 30, in case of employment of the tape having low rigidity such as the fabric tape 153, the regulation guide 500A cannot sufficiently exhibit function of restricting widthwise displacement of the tape, and therefore, it would be difficult to avoid diagonal running of the tape and generation of folding and wrinkle of the tape.

[Film Spring]

To this effect, a film spring 600 (FIG. 4) made from resin is provided in the portion 34 at a position upstream of the tape lead-out opening 34*a* and along the conveying passage of the fabric tape 153. Incidentally, the film spring 600 is not delineated in FIGS. 6 through 9 to avoid complexity of the drawing. The film spring 600 is an example of a pressure member.

Figure 10:
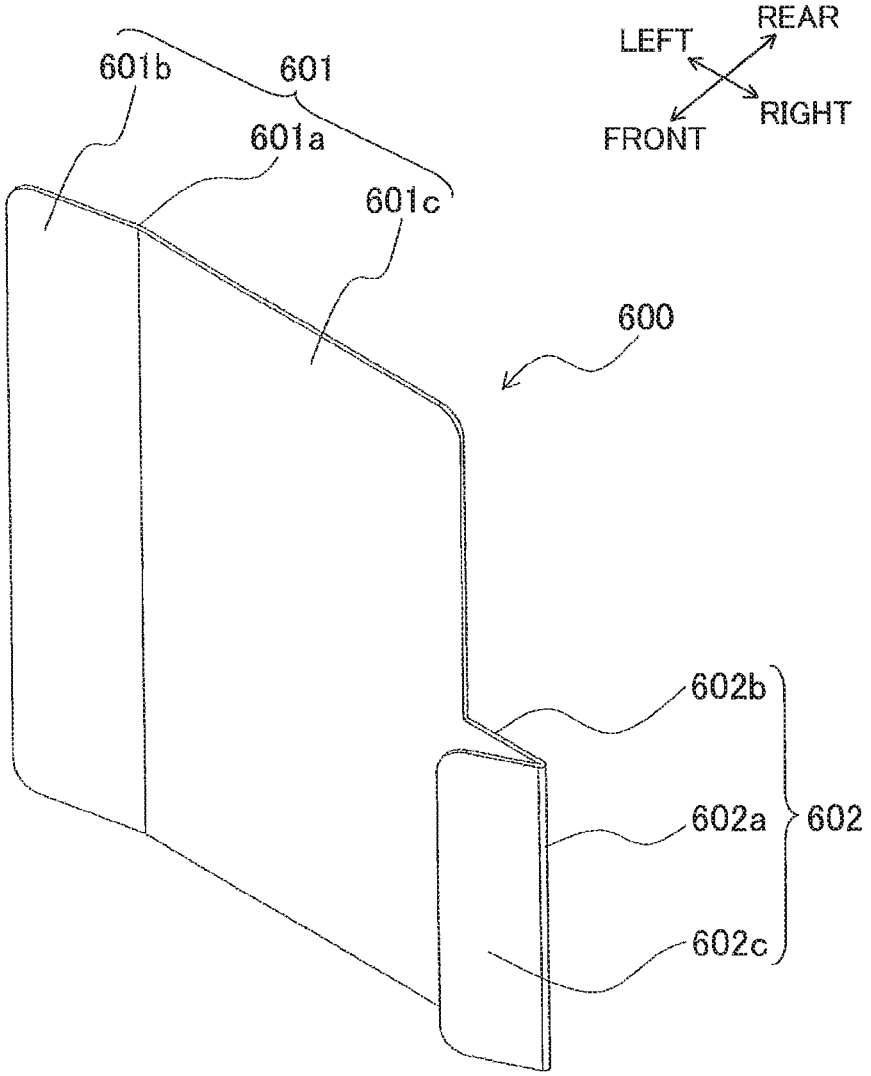
FIG. 10 is a perspective view illustrating a detail of a film spring provided in the tape cartridge according to the first embodiment.
Figure 11:
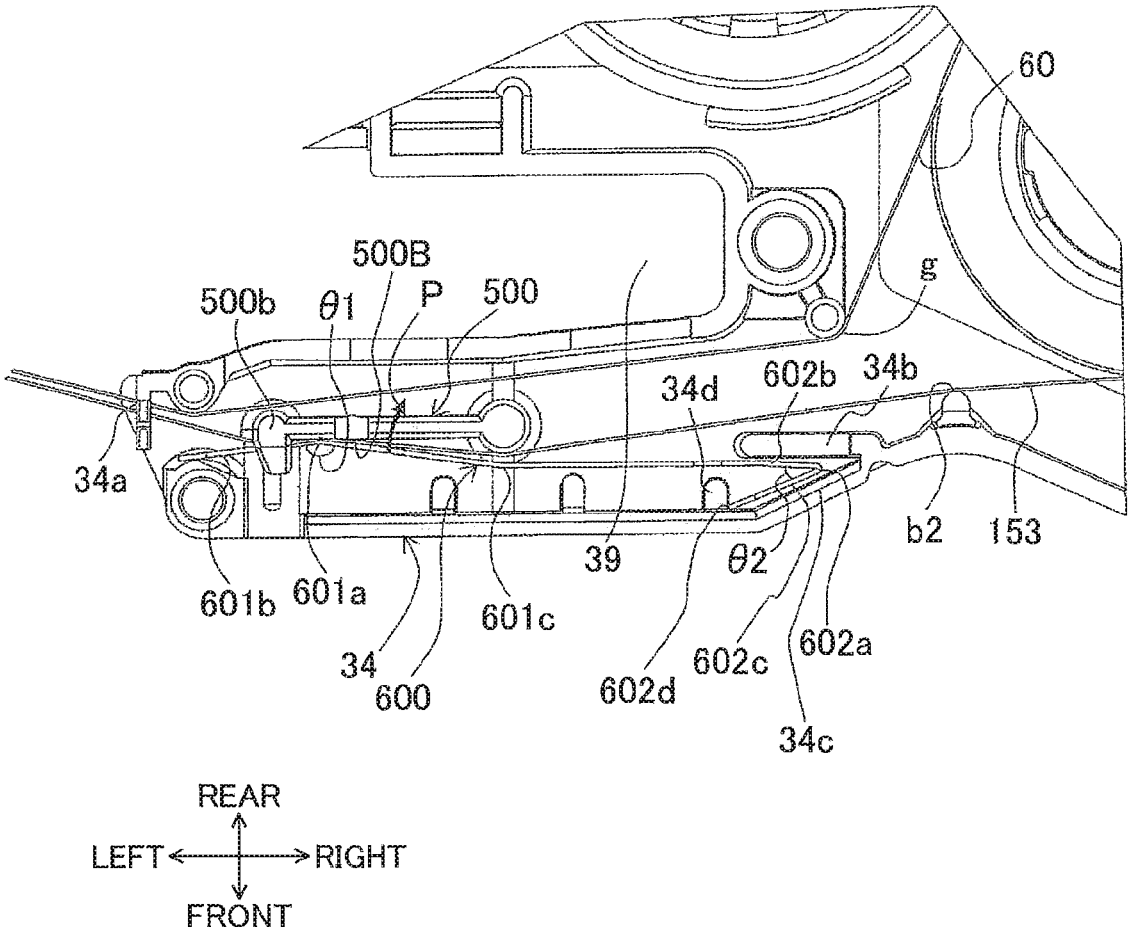
FIG. 11 is an enlarged view illustrating a structure ambient to the film spring in the tape cartridge according to the first embodiment.

As illustrated in FIGS. 10 and 11, the film spring 600 includes a spring body portion 601 and an attachment portion 602 for attaching the spring body portion 601 to the arm portion 34, The film spring 600 is positioned frontward of the conveying passage of the fabric tape 153.

The spring body portion 601 is bent at a bending line 601*a* to provide a tip end portion 601*b* positioned leftward of the bending line 601*a* and a base portion 601*c* positioned rightward of the bending line 601*a*. The spring body portion 601 protrudes rearward at the bending line 601*a*. The tip end portion 601*b* and the base portion 601*c* define therebetween an obtuse angle θ1 of nearly 180 degrees.

As illustrated in FIG. 11, the arm portion 34 further includes a sloped wall 34*c* constituting a part of an outline of the arm portion 34, a pawl portion 34*b* extending leftward in the internal space of the arm portion 34 from the sloped wall 34*c*, and an engagement protrusion 34*d* protruding inward and positioned leftward of the sloped wall 34*c*. The engagement protrusion 34*d* is an example of a "second wall".

The attachment portion 602 is bent into V-shape at a bending line 602*a*. That is, the attachment portion 602 includes a support portion 602*b* and an engagement portion 602*c* connected to the support portion 602*b* at the bending line 602*a*. The support portion 602*b* is integral with and flush with the base portion 601*e* of the spring body portion 601. The support portion 602*b* is in abutment with a front surface of the pawl portion 34*b*.

The engagement portion 602*c* extends along an inner surface of the sloped wall 34*c*, and has a tip end 602*d* engaged with the engagement protrusion 34*d*. That is, the engagement protrusion 34*d* is positioned downstream of the tip end 602*d* of the engagement portion 602.*c* in the conveying passage of the fabric tape 153 so as to prevent the tip end portion 602*d* from further moving in downward direction.

In a state illustrated in FIG. 11, the support portion 602*a* and the engagement portion 602*c* define therebetween an acute angle θ2. Further, the attachment portion 602 is forcibly resiliently deformed to reduce the angle θ2 against inherent urging force of the attachment portion 602. As a result, a resilient restoration force for increasing the angle θ2 is applied to the support portion 602 continuous with the spring body portion 601. At this time, the position of the spring body portion 601 relative to the arm portion 34 is roughly fixed by the abutment between the support portion 602*b* and the pawl portion 34*b*.

Further, the resilient restoration force urges the spring body portion 601 rearward (in a direction perpendicular to the surface of the fabric tape 153) to contact the fabric tape 153 conveyed in the arm portion 34. That is the spring body portion 601 applies rearward force to the fabric tape 153 as indicated by an arrow P in FIG. 11, In other words, urging force in the direction for contacting the fabric tape 153 is imparted on the film spring 600 by the restoration force of the attachment portion 602.

Further, the separation wall 500 further includes a guide protrusion 500E protruding frontward from the front surface 500C of the separation wall 500 and positioned upstream of the regulation guide 500A in the conveying direction of die fabric tape 153. The guide protrusion 500B is an example of one of the two protrusions. The film spring 600 is configured to nip the fabric tape 153 in cooperation with the separation wall 500. Specifically, the bending line 601*a* and a portion adjacent thereto of the spring body portion 601 contacts the fabric tape 153 at a position between the base portion 500*a* and the guide protrusion 500B.

Advantageous Effect in First Embodiment

According to the above-described first embodiment, displacement of the fabric tape 153 in its widthwise direction can be restricted by the regulation guide 500A when the fabric tape 153 paid out from the tape roll 206 is conveyed along the conveying passage. At this time, the film spring 600 contacts and presses against the fabric tape 153 as indicated by the arrow P in FIG. 11. Hence, a tensile force is applied to the fabric tape 153 conveyed along the conveying passage. Accordingly, the fabric tape 153 can be conveyed under tension in spite of low rigidity of the fabric tape 153. As a result, the regulation guide 500A can exhibit sufficient function of restricting widthwise displacement of the fabric tape 153.

Figure 9A:
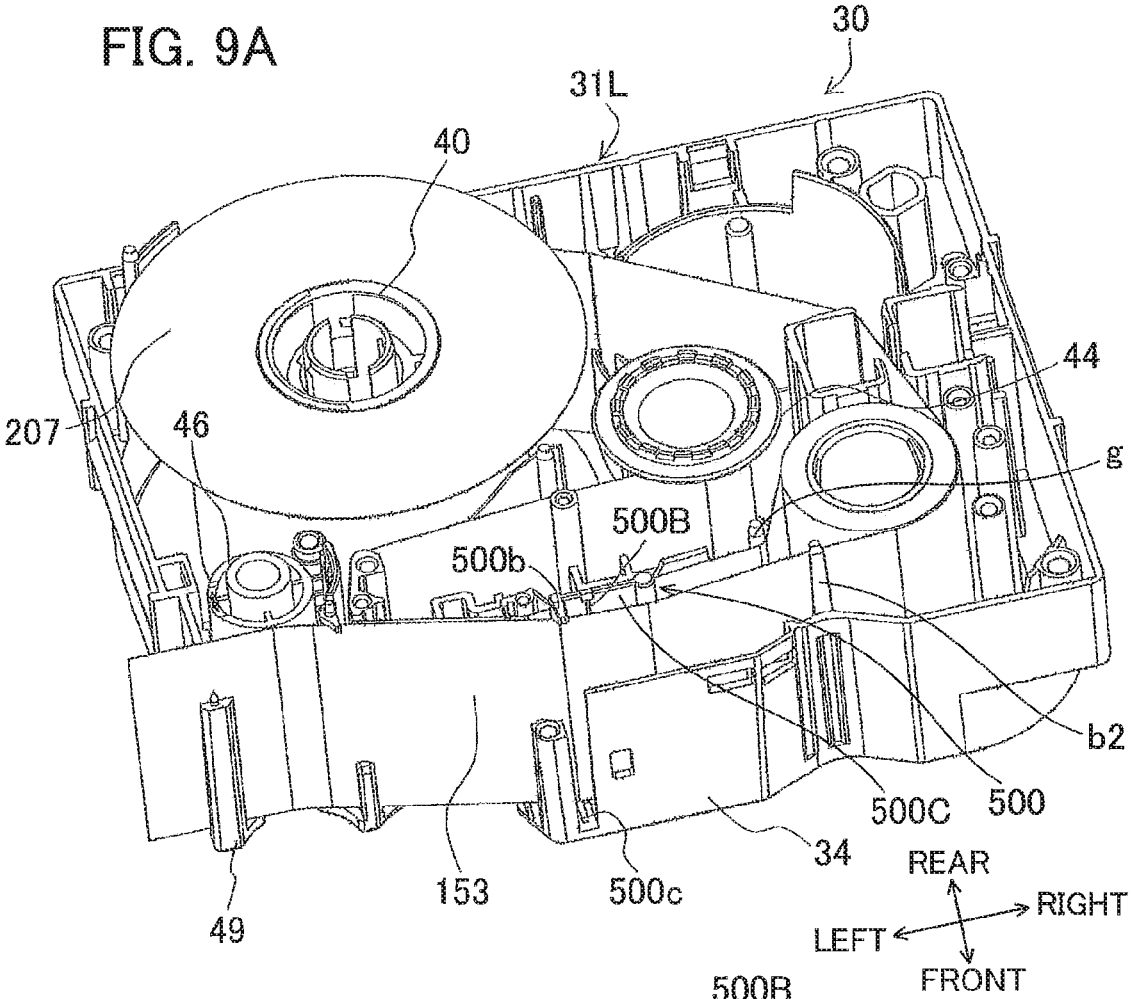
FIG. 9A is a perspective view illustrating the view of FIG. 8A and also illustrating the tape.
Figure 9B:
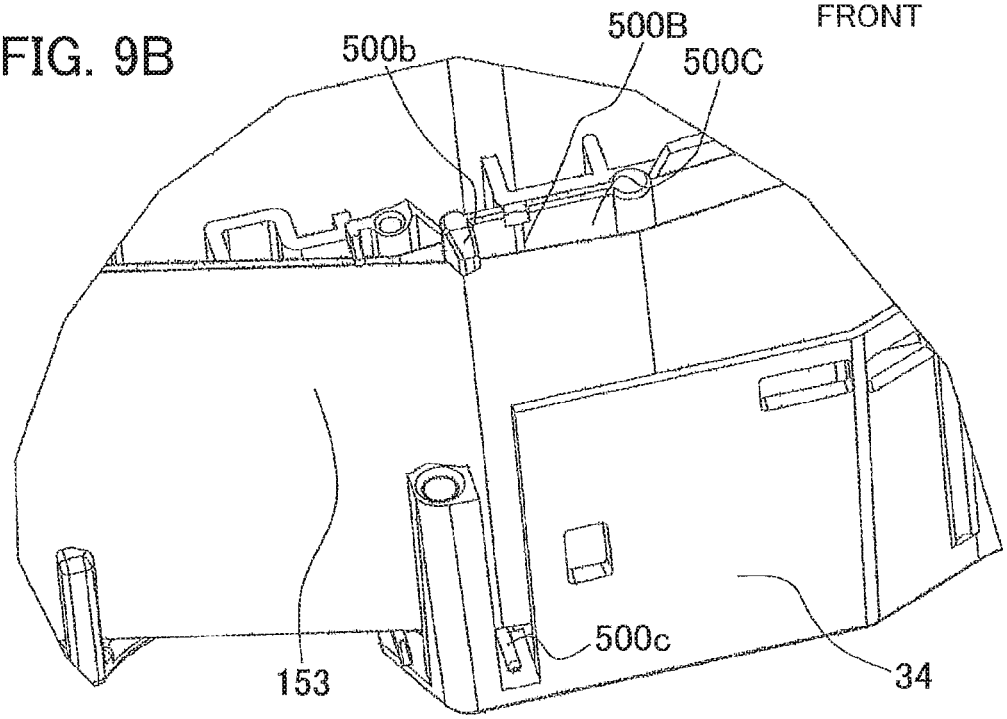
FIG. 9B is an enlarged view of an essential portion illustrated in FIG. 9A.

Specifically, as described in connection with FIGS. 8 and 9, the regulation guide 500A has generally U-shape including the upper guide portion 500*b*, the base portion 500*a*, and the lower guide portion 500*c*. On a basis of positional relationship between the regulation guide 500A and the conveying passage of the fabric tape 153 extending from the tape roll 206 as illustrated in FIGS. 4, 6, 9A and 9B, the tension of the fabric tape 153 is increased, so that the fabric tape 153 can be brought into intimate contact with the base portion 500*a* during moving past the regulation guide 500A.

Further, the pressing force from the film spring 600 in the direction of the arrow P also urges the fabric tape 153 toward the base portion 500*a*. Consequently, the regulating function by means of the upper guide portion 500*b* and the lower guide portion 500*c* for restricting widthwise displacement of the fabric tape 153 can be sufficiently exhibited during moving past the regulation guide 500A, thereby restraining the fabric tape 153 from diagonal moving, folding, and generation of wrinkle at the time of conveyance of the fabric tape 153.

Particularly, the regulating function of the regulation guide 500A can be promoted by applying tension to the fabric tape 153 in such a manner that the film spring 600 positioned in the arm portion 34 presses against the fabric tape 153 in the direction perpendicular to the surface of the fabric tape 153.

Particularly, tensile force is imparted on the fabric tape 153 by the film spring 600, while the fabric tape 153 is nipped between the film spring 600 and the separation wall 500 that is positioned between the conveying passage of the ink ribbon 60 and the conveying passage of the fabric tape 153. Hence, the regulating function of the separation wall 500 can further be improved.

Particularly, the separation wall 500 includes the base portion 500*a* and the guide protrusion 500B, and the film spring 600 contacts the fabric tape 153 at the position between the base portion 500*a* and the guide protrusion 500B. Therefore, the fabric tape 153 is conveyed along the meandering passage contacting the guide protrusion 500B, the film spring 600, and the base portion 500*a* in this order. The contacts of the fabric tape 153 with the guide protrusion 500B, the film spring 600, and the base portion 500*a* and the meandering of the conveying passage can stably impart tension on the fabric tape 153.

Particularly, the film spring 600 is set in the arm portion 34 in resiliently deformed state against its natural shape, so that the film spring 600 contacts and presses against the fabric tape 153 by the resilient restoration force of the film spring 600. This restoration force can stably apply pressing force to the fabric tape 153.

Particularly, the engagement wall 34*d* is positioned downstream of the tip end 602*d* of the film spring 600 in the conveying direction of the fabric tape 153. Hence, even though the film spring 600 is urged to be moved toward downstream side in the conveying direction of the fabric tape 153 along with the movement of the fabric tape 153, the engagement wall 34*d* can prevent the film spring 600 from moving toward the downstream side. Further, displacement of the film spring 600 from its regular position due to user's handling error can also be obviated.

Generally, the fabric has low rigidity or linearity. Hence, deformation or buckling may likely to occur during conveyance of the fabric tape. However, in the tape cartridge 30 according to the first embodiment, conveyance of the fabric tape 153 can be performed under tension. Thus, regulating effect by the regulation guide 500A can be sufficiently exhibited.

Figure 7:
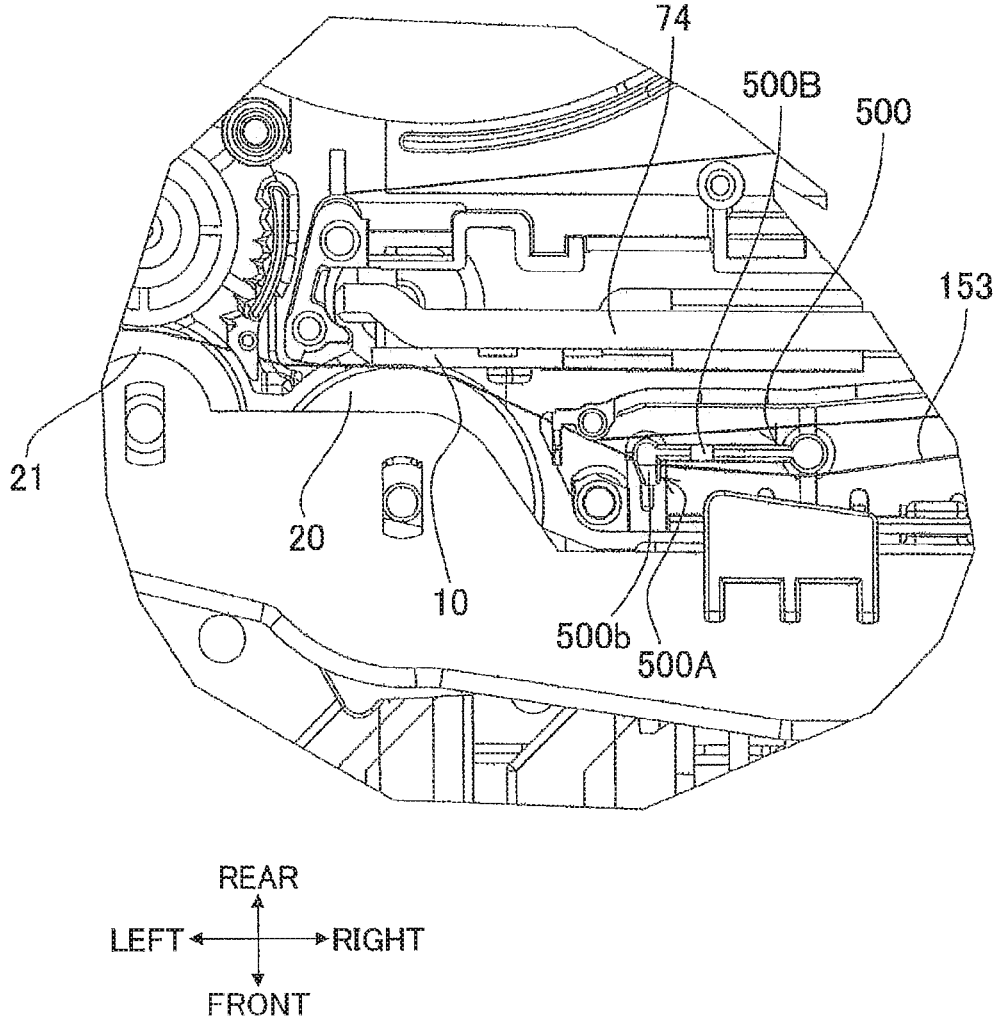
FIG. 7 is an enlarged view of an essential portion illustrated in FIG. 6.
Figure 8A:
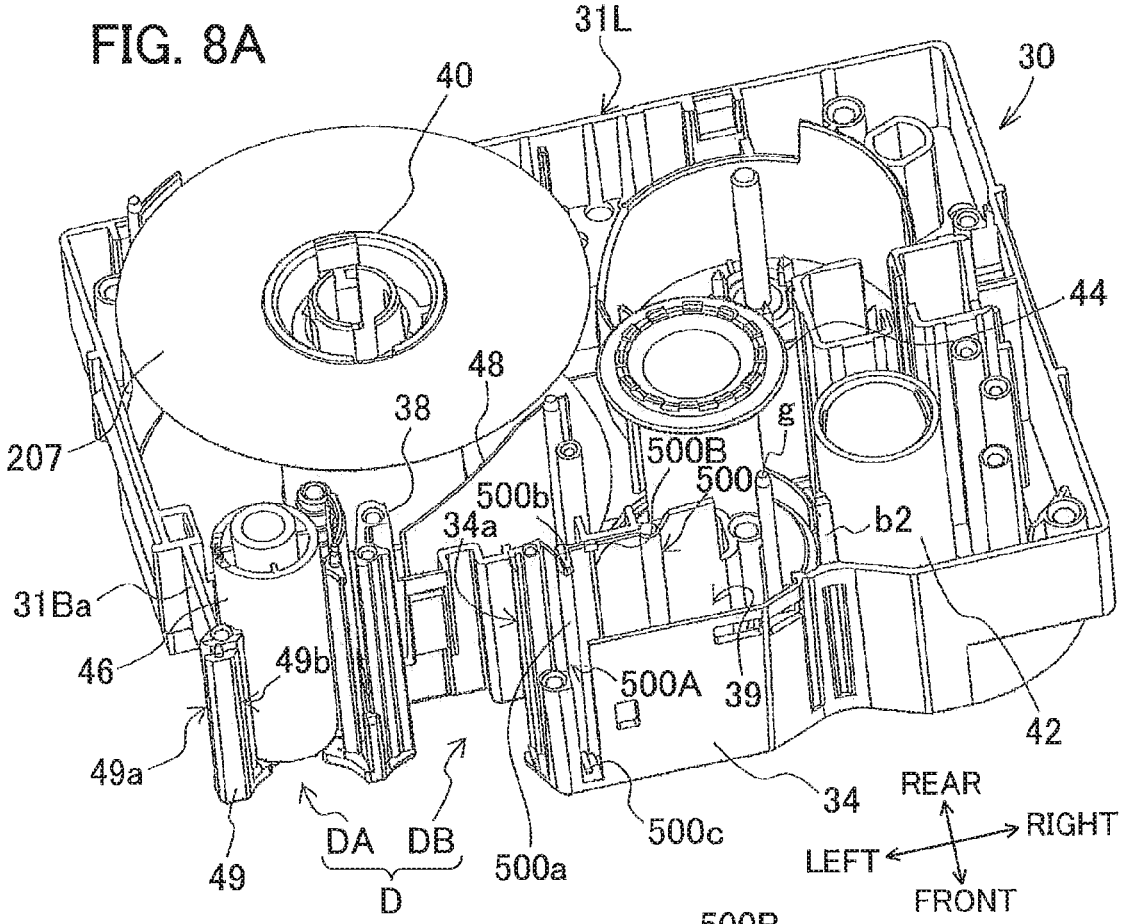
FIG. 8A is a perspective view illustrating the internal structure of the tape cartridge with omitting the upper wall of the casing and the tape.
Figure 8B:
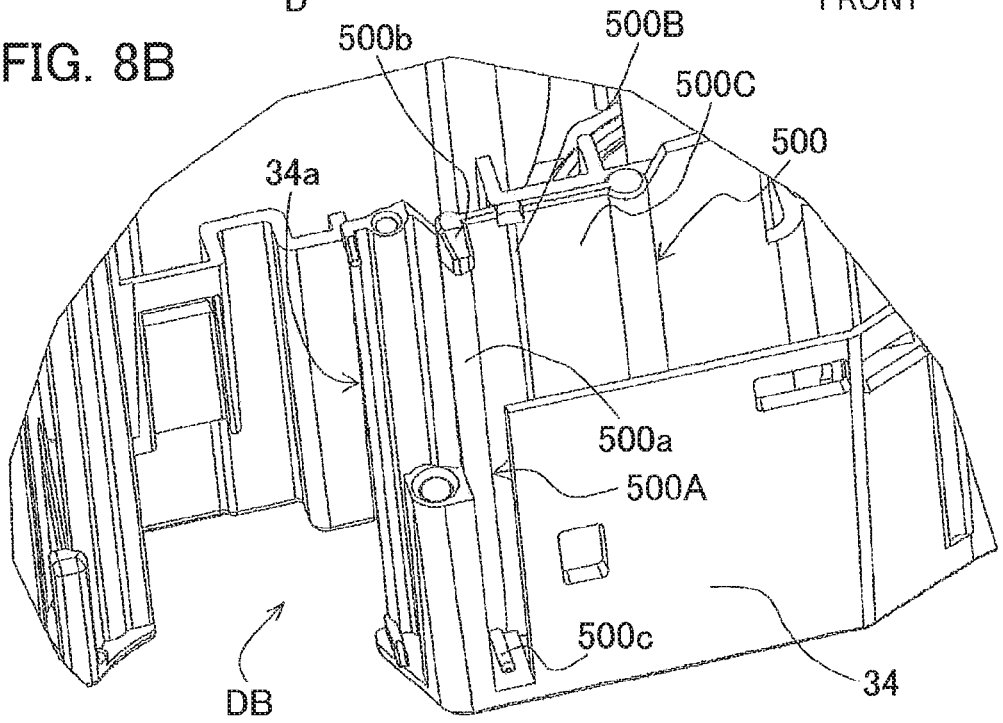
FIG. 8B is an enlarged view of an essential portion illustrated in FIG. 8A.

Particularly, as illustrated in FIGS. 6 and 7, after attachment of the tape cartridge 30 to the cartridge receiving portion 8, the conveying passage of the fabric tape 153 is bent by the platen roller 20 and the regulation guide 500A. Since apparent geometrical moment of inertia at the bending portion of the fabric tape 153 increases by the bending of the fabric tape 153 at two locations, tensile force can be securely imparted on the fabric tape 153.

Next, a tape cartridge 130 according to a second embodiment will be described with reference to FIGS. 12 and 13 wherein like parts and components are designated by the same reference numerals as those shown in FIGS. 1 through 11. In the second embodiment, a pressure member for imparting tensile force on the fabric tape 153 is different from the film spring 600 in the first embodiment.

Figure 12:
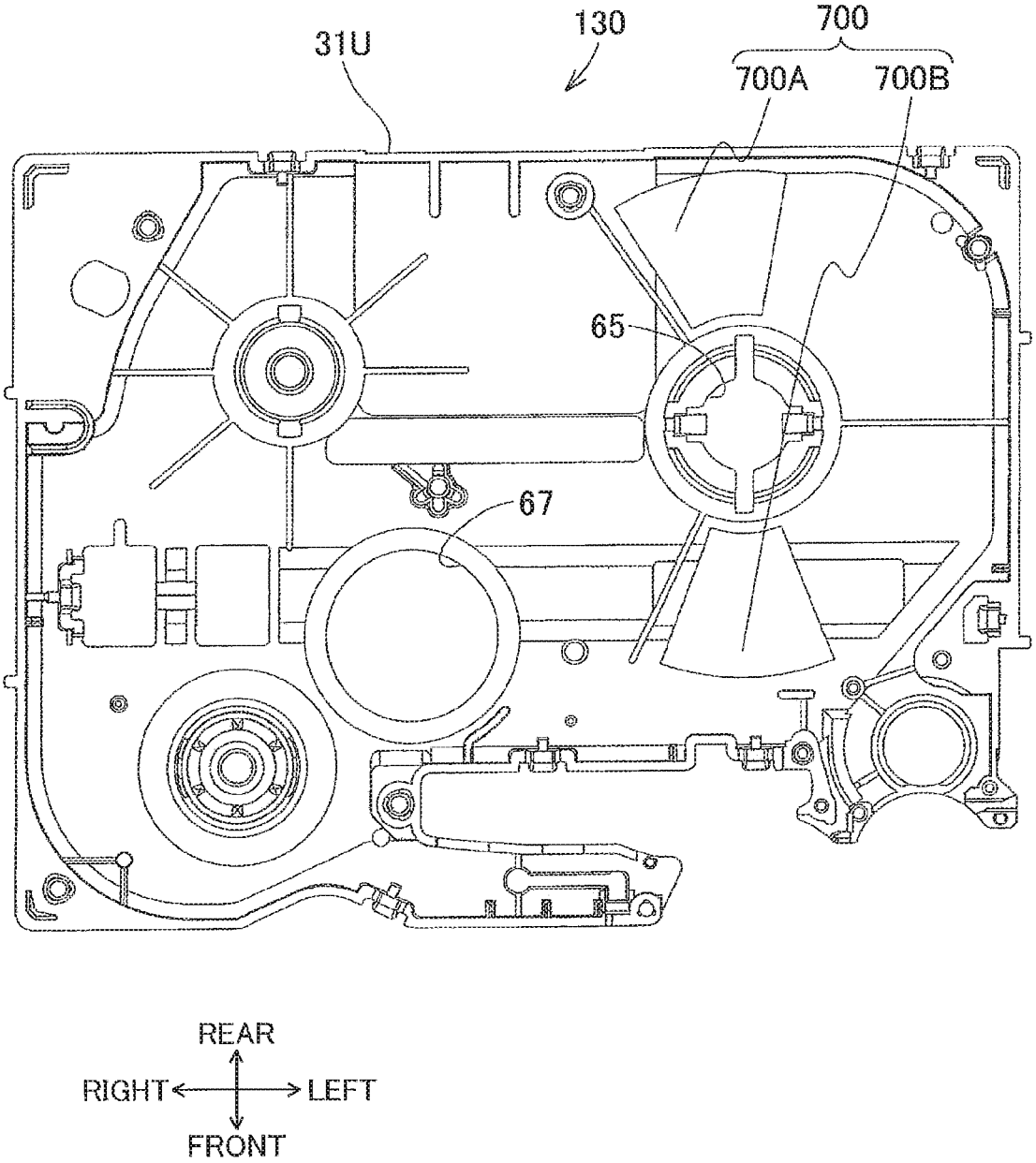
FIG. 12 is a back-side view of an upper wall of a casing of a tape cartridge according to a second embodiment.
Figure 13:
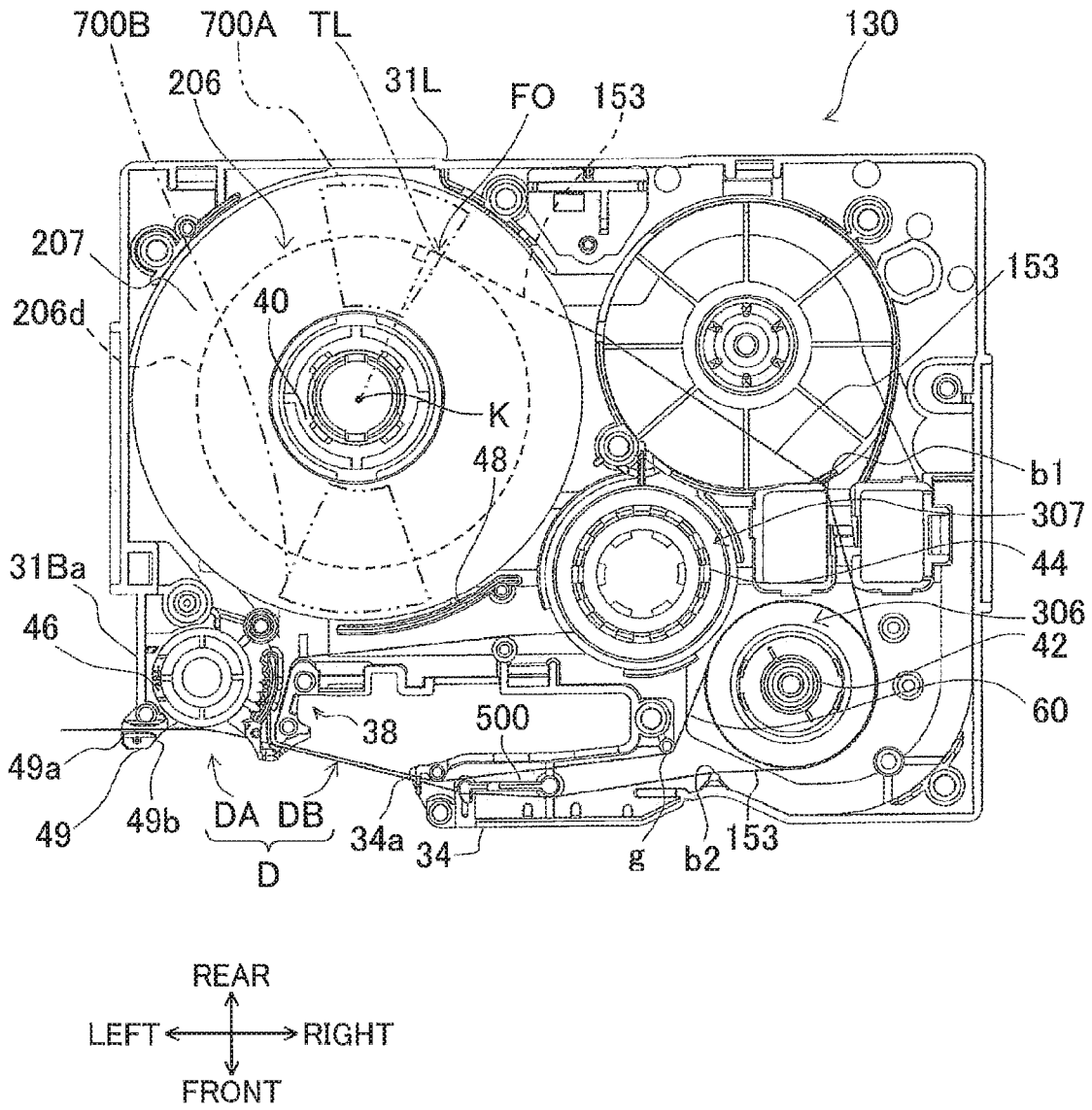
FIG. 13 is a plan view illustrating an internal structure of the tape cartridge according to the second embodiment with omitting the upper wall.

As illustrated in FIGS. 12 and 13, in the tape cartridge 130 according to the second embodiment, the film spring 600 is not provided, but instead, elastic members 700A and 700B are provided at a position between the resin film 207 and the upper wall 31U of the cartridge body 31 for applying pressure to the resin film 207. The elastic members 700A and 700B will be appropriately collectively described as an elastic member 700. Specifically, the resin film 207 is urged to be in contact with one widthwise end (upper end) of the fabric tape 153 of the tape roll 206 by the elastic member 700, so that resin film 207 presses the fabric tape 153 downward. In other words, pressing force of the resin film 207 against the fabric tape 153 in the widthwise direction thereof is generated by the elastic member 700.

The elastic member 700 is adhesively fixed to a lower surface of the upper wall 31U, the lower surface facing the resin film 207. The elastic member 700 is preferably made from sponge or rubber. The elastic members 700A, 700B each having a sector shape are illustrated by a solid line and two dotted chain line in FIGS. 12 and 13, respectively.

As illustrated in FIGS. 12 and 13, the elastic members 700A and 700B are positioned at diametrically opposite sides with respect to the axis K of the tape roll 206. That is, the elastic member 700A is positioned rearward of the axis K, and the elastic member 700B is positioned frontward of the axis K. Further, at least a part of the elastic member 700 (the elastic member 700A in the second embodiment) contains a portion that presses a part of the resin film 207 at a position superposed with a feed-out portion FO at which the fabric tape 153 is unwound from the tape roll 206. Particularly, the elastic member 700A contains a portion that presses at least a part of the resin film 207 superposed with a tangential line TL at an outer diameter 206*d* of the tape roll 206.

Advantageous Effect in Second Embodiment

The second embodiment exhibits the function the same as that of the first embodiment. That is, displacement of the fabric tape 153 in its widthwise direction can be restricted by the regulation guide 500A when the fabric tape 153 paid out from the tape roll 206 is conveyed along the conveying passage. At this time, the resin film 207 contacts and presses against the fabric tape 153 by the pressing force from the elastic member 700. Hence, a tensile force is applied to the fabric tape 153 conveyed along the conveying passage. Accordingly, the fabric tape 153 can be conveyed under tension in spite of low rigidity of the fabric tape 153. As a result, the regulation guide 500A can exhibit sufficient function of restricting widthwise displacement of the fabric tape 153.

As a result, the regulating function by means of the upper guide portion 500*b* and the lower guide portion 500*c* for restricting widthwise displacement of the fabric tape 153 can be sufficiently exhibited during moving past the regulation guide 500A, thereby restraining the fabric tape 153 from diagonal moving, folding, and generation of wrinkle at the time of conveyance of the fabric tape 153, Even though the fabric tape 153 is inherently easily deformed or buckled, the regulating function by the regulation guide 500A can be sufficiently exhibited, since the fabric tape 153 can be conveyed under tension. Further, as described in the first embodiment in connection with FIGS. 6 and 7, the tension can be securely imparted on the fabric tape 153 since the fabric tape 153 is bent along the two locations such as along the platen roller 20 and the regulation guide 500A.

Particularly, in the second embodiment, restricting function of the regulation guide 500A can be sufficiently exhibited, since the resin film 207 is positioned between the tape roll 206 and the cartridge case 31 and presses against the widthwise end of the fabric tape 153 to impart tension on the fabric tape 153.

Particularly, in the second embodiment, the elastic member 700A positioned between the resin film 207 and the cartridge case 31 presses against the resin film 207, so that the pressure from the elastic member 700A is applied to the widthwise end of the fabric tape 153 through the resin film 207, thereby generating sufficient tension in the fabric tape 153. Hence, sufficient restricting function of the regulation guide 500A can be exhibited.

Particularly, in the second embodiment, the elastic members 700A and 700B are positioned at diametrically opposite sides to each other with respect to the axis K of the tape roll 206. Hence, stabilized pressing force can be applied to the tape roll 206 from the elastic members.

Particularly, in the second embodiment, the elastic member 700 presses against at least the portion of the resin film 207, the portion being overlapped with the feed out portion FO of the fabric tape 153 from the tape roll 206. Therefore, pressing force of the elastic member 700 can be securely applied to the fabric tape 153 fed out to the conveying passage from the tape roll 206.

Particularly, in the second embodiment, the elastic member presses against at least the portion of the resin film 207, the portion being overlapped with a tangential lire TL at the outer diameter 206*d* of the tape roll 206. Therefore, pressing force of the elastic member 700 can be securely applied to the fabric tape 153 fed out to the conveying passage from the tape roll 206.

In the second embodiment, the elastic members 700A, 700B may be omitted as long as (a) the resin film 207 is in intimate contact with the upper wall 31U and the widthwise edge of the roll of the fabric tape 153, (h) the resin film 207 has a sufficient elasticity for pressing against the widthwise edge of the roll of the fabric tape 153, and (c) the resin film 207 has a low friction co-efficient with respect to the widthwise edge of the roll of the fabric tape 153.

In the above-description, the terms "vertical", "parallel", and "flat", and the like are not in the narrowest sense. That is, production tolerance and manufacturing error are inclusive in these terms, and thus, "substantially vertical" "substantially parallel" and "substantially flat" are also within the meaning of these terms.

In the above description, the terms "identical", "equal", "different" and the like with respect to dimension and size are not in the narrowest sense. Production tolerance and manufacturing error are inclusive in these terms, and thus, "substantially identical", "substantially equal", and "substantially different" are also within the meaning of these terms.

While the description has been made in detail with reference to the specific embodiments, it would be apparent to those skilled in the art that various changes and modifications may be made without departing from the scope of the disclosure. For example, the film spring 600 in the first embodiment and the elastic member 700 in the second embodiment may be co-provided in the tape cartridge.

What is claimed is:

1. A tape cassette comprising:

a tape roll formed by winding a tape, the tape having a width defining a widthwise direction;

a casing accommodating therein the tape roll, a tape conveying passage being defined in the casing;

a regulation guide positioned at the tape conveying passage to restrict displacement of the tape in the widthwise direction; and a resin film positioned upstream of the regulation guide in a conveying direction of the tape and along the tape conveying passage, the resin film being in contact with the tape in a contacting direction to apply pressing force to the tape in the contacting direction, wherein the tape cassette further comprises an arm portion, the arm portion comprising a tape lead-out portion through which the tape is directed toward an outside of the tape cassette, wherein the resin film is positioned in the arm portion and along the tape conveying passage at a position upstream of the tape lead-out portion in the conveying direction of the tape, the contacting direction being perpendicular to a surface of the tape, wherein the tape cassette further comprises a first wall positioned in the arm portion and extending along the tape conveying passage, the first wall having an upstream end portion and a downstream end portion in the conveying direction of the tape, the regulation guide being positioned at the downstream end portion of the first wall, and wherein the resin film contacts the tape at a position between the upstream end portion and the downstream end portion of the first wall in the conveying direction of the tape, thereby nipping the tape in cooperation with the first wall, wherein the first wall includes two protrusions, and wherein the resin film contacts the tape at a position between the two protrusions of the first wall in the conveying direction of the tape.

2. The tape cassette according to claim 1, further comprising:

a ribbon roll accommodated in the casing and formed by winding an ink ribbon, the ink ribbon being conveyed along an ink ribbon conveying passage; and a ribbon take-up roll accommodated in the casing and formed by taking up the ink ribbon from the ribbon roll, wherein the first wall is positioned between the tape conveying passage and the ink ribbon conveying passage.

3. The tape cassette according to claim 1, wherein the resin film is set in the arm portion in a forcibly resiliently deformed state, the resin film having a resilient restoration force to contact and press against the tape.

4. The tape cassette according to claim 1, wherein the resin film has one end, and wherein the tape cassette further comprises a second wall positioned in the arm portion at a position downstream of the one end of the resin film in the conveying direction to prevent the resin film from moving in a downstream direction.

5. The tape cassette according to claim 1, wherein the tape is a fabric tape.

6. The tape cassette according to claim 1, wherein the tape cassette is used for a printer including a thermal head and a cassette holder to which the tape cassette is attachable, wherein the printer includes a platen roller facing the thermal head when the tape cassette is attached to the cassette holder, and wherein the tape conveying passage is bent at the platen roller and at the regulation guide.

7. The tape cassette according to claim 1, wherein the resin film applies pressing force to the tape, whereupon the tape applies pressing force to the first wall.

8. The tape cassette according to claim 1, wherein the resin film contacts the tape at a position upstream of the tape lead-out portion in the conveying direction along the tape conveying passage.

9. A tape cassette comprising:

a tape roll formed by winding a fabric tape, the fabric tape having a width defining a widthwise direction;

a casing having a surface and accommodating therein the tape roll, a tape conveying passage being defined in the casing; and a pressure member, the pressure member being in contact with the fabric tape in a contacting direction to apply pressing force to the fabric tape in the contacting direction, wherein the pressure member comprises a resin film and a sponge member, which are arranged between the tape roll and the surface of the casing in the widthwise direction, such that the resin film is in direct contact with a widthwise edge of the tape roll and the sponge member is positioned between the resin film and the surface of the casing, wherein the sponge member extends in a radial direction of the tape roll and has a radially-inward edge and a radially-outward edge opposite to the radially-inward edge in the radial direction, the sponge member being arranged relative to the tape roll such that a radially-outward edge of the tape roll is positioned between the radially-inward edge of the sponge member and the radially-outward edge of the sponge member in the radial direction of the tape roll, the sponge member being configured to elastically urge the resin film in the contacting direction toward the widthwise edge of the tape roll, thereby bringing the resin film into pressure contact with the widthwise edge of the tape roll so as to apply pressure to the widthwise edge of the fabric tape through the resin film.

10. The tape cassette according to claim 9, wherein the sponge member is adhesively fixed to the surface of the casing, the surface facing the resin film.

11. The tape cassette according to claim 9, wherein the sponge member comprises a first sponge member and a second sponge member positioned at a position diametrically opposite to the first sponge member with respect to an axis of the tape roll.

12. The tape cassette according to claim 9, wherein the tape roll has a feed-out portion at which the fabric tape is fed out from the tape roll toward the tape conveying passage, the feed-out portion being positioned at the radially-outward edge of the tape roll, and wherein the sponge member presses against at least a portion of the widthwise edge of tape roll through the resin film at a position corresponding to the feed-out portion.

13. The tape cassette according to claim 12, wherein the sponge member presses against at least a portion of the widthwise edge of the tape roll through the resin film at a position corresponding to a tangential line that extends from the feed-out portion at the radially-outward edge of the tape roll.

14. The tape cassette according to claim 9, wherein the tape cassette is used for a printer including a thermal head and a cassette holder to which the tape cassette is attachable, and wherein the printer includes a platen roller facing the thermal head when the tape cassette is attached to the cassette holder, and wherein the tape conveying passage is bent at the platen roller.

15. The tape cassette according to claim 9, wherein as viewed in the widthwise direction, the resin film is overlapped with an entire part of the tape roll.

* * * * *